United States Patent [19]

Nüsser

[11] Patent Number: 4,579,017

[45] Date of Patent: Apr. 1, 1986

[54] RESTORING DEVICE FOR AN ADJUSTING ELEMENT

[75] Inventor: Hermann Nüsser, Markgröningen, Fed. Rep. of Germany

[73] Assignee: Robert Bosch GmbH, Stuttgart, Fed. Rep. of Germany

[21] Appl. No.: 621,657

[22] Filed: Jun. 18, 1984

[30] Foreign Application Priority Data

Aug. 10, 1983 [DE] Fed. Rep. of Germany ..... 3328854

[51] Int. Cl.[4] ..... F02B 77/08

[52] U.S. Cl. ..... 74/519; 16/305; 251/279; 251/243; 251/293; 267/155; 188/77 W; 123/198 B; 123/198 D

[58] Field of Search ..... 74/519; 123/188 SC, 123/198 D, 198 B; 16/305; 251/243, 279, 293; 188/77 W, 82.6; 267/155

[56] References Cited

U.S. PATENT DOCUMENTS

| | | | |
|---|---|---|---|
| 3,698,372 | 10/1972 | Eshelman et al. | 123/198 D |
| 3,704,635 | 12/1972 | Eshelman | 123/198 D |
| 3,927,657 | 12/1975 | Mennesson | 123/198 D |
| 3,943,907 | 3/1976 | Kluth | 123/198 D |

*Primary Examiner*—Kenneth J. Dorner

*Attorney, Agent, or Firm*—Edwin E. Greigg

[57] ABSTRACT

A restoring device for an adjusting element, which serves in particular for restoring a throttle device of an internal combustion engine. The restoring device has a first spring subject to bending, which is disposed on a bushing that is rotatably supported about a throttle valve shaft and with one end engages a step of the bushing, while the other end of the spring is hooked onto the housing on the throttle valve fitting. A lever is connected with the shaft. The first spring subject to bending acts in the restoring direction of the throttle valve. A second spring subject to bending is disposed in the bushing, one end of this spring engaging the bushing and the other end being supported on the lever. The spring force of the second spring subject to bending is less than that of the first such spring, so that the bushing, with a stop step, is rotated so far that the second spring has not influence in the restoring direction upon the throttle valve. If the first spring should break, the second spring rotates the bushing, with the stop step, until such time as the stop step comes to rest on a stop face of the throttle valve fitting and the second spring subject to bending now acts upon the lever in the restoring direction.

4 Claims, 3 Drawing Figures

RESTORING DEVICE FOR AN ADJUSTING ELEMENT

BACKGROUND OF THE INVENTION

The invention is based on a restoring device for an adjusting element, in particular for a throttle device of an internal combustion engine. A restoring device is already known in which a return spring subjected to bending engages an actuation member in the restoring direction. An embodiment of such a spring has the disadvantage that if the spring subjected to bending should break, no further restoring force is exerted upon the actuation member and hence this member is no longer returned automatically to its initial position.

OBJECT AND SUMMARY OF THE INVENTION

The restoring device according to the invention has the advantage over the prior art that a second spring subject to bending is provided, which has no influence on the restoration of the actuation member so long as the first such spring is capable of functioning; however, if the first spring subject to bending should be defective the second spring comes into use and urges the actuation member in the restoring direction.

By means of the characterics recited herein advantageous further developments of and improvements to the restoring device are attainable. It is particularly advantageous for the first and second springs subject to bending to be disposed one inside the other, so that the device can be accommodated in a small space.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
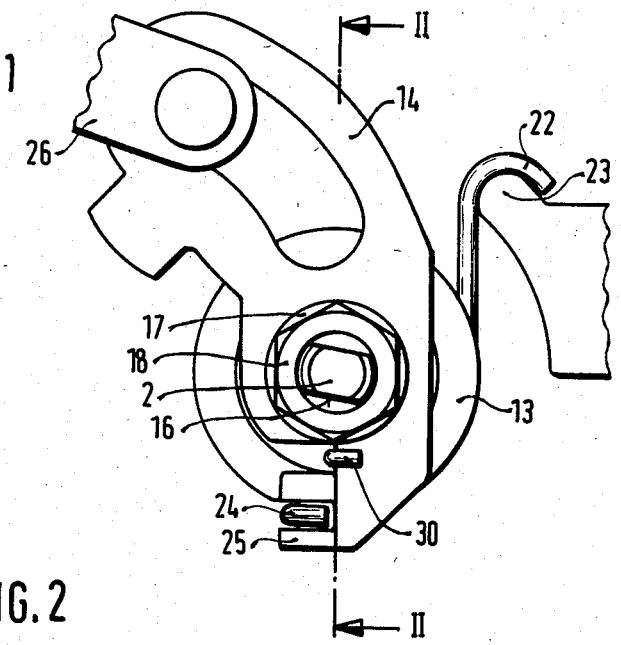
FIG. 1 shows a restoring device according to the invention for an adjusting element in plan view.
Figure 2:
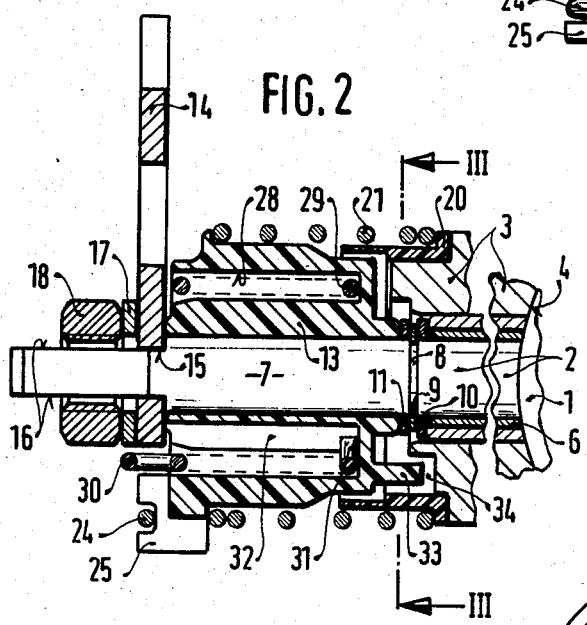
FIG. 2 is a section taken along the line II—II of FIG. 1.
Figure 3:
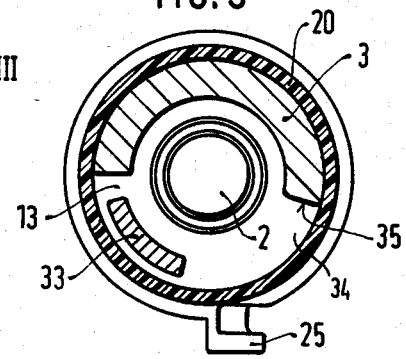
FIG. 3 is a section taken along the line III—III of FIG. 2.

The restoring device for an adjusting element shown in FIGS. 1, 2 and 3 serves for example to restore a throttle valve 1, acting as the adjusting element, of an internal combustion engine not otherwise shown. The throttle valve 1 is connected in a rotationally fixed manner with a shaft 2 and to a variable extent controls the quantity of air flowing through an intake tube 4 embodied in a throttle valve fitting 3. The shaft 2 is rotatably supported in a sleeve bearing 6 of the throttle valve fitting 3 by way of example and has one end 7 that protrudes out of the throttle valve fitting 3. A snap ring 9 is disposed in an annular groove 8 of the shaft 2, on which snap ring 9 is secured between an annular disc 10, oriented toward the slide bearing, and an annular disc 11 on the other side, and disposed on the shaft 2. Resting against the annular disc 11, a bushing 13 is rotatably supported on the shaft 2, its axial movement being limited on the outer end by a lever 14 acting as an actuation member. The lever 14 has a through opening 15, with which it can be pushed onto the end 7 of shaft 2, which has flattened areas 16, of the shaft 2 and then fastened in place by a threaded nut 18 with an interposed shim 17 between the lever 14 and the nut. Coaxially with the shaft 2, a bearing bushing 20 is disposed on and surrounds a portion of the throttle valve fitting 3. This bushing 20 guides a first coiled return spring 21 subjected to a bending restoring force, which extends coaxially with the shaft 2 and is embodied in helical form. The end 22 of the coil spring oriented toward the bearing bushing 20 is bent in the shape of a hook and suspended from a protrusion 23 of the throttle valve fitting 3, while the other end 24 of this first spring 21 subject to bending engages the bushing 13. The end 24 of the spring is bent in the form of a hook, and engages a step 25 of the bushing 13 in such a manner that the step 25 comes to rest on an edge of the lever 14 and urges it in the restoring direction; that is, it tends to rotate it in the closing direction of the throttle valve 1. The actuation of the throttle valve 1, in an internal combustion engine, is effected by a so-called gas pedal, not shown, which via a lever linkage 26 engages the lever 14 and by way of which the throttle valve 1 is rotatable into the opening position counter to the force of the first spring 21 subject to a bending restoring force.

In accordance with the invention, a helically embodied second coil spring 29 subject to a bending restoring force is disposed in an annular groove 28 of the bushing 13, extending coaxially with the shaft 2. One end 30 of this spring 29 protrudes out of the annular groove 28 and engages the lever 14, while the other end 31 is bent and protrudes for example into a longitudinal groove 32 of the bushing 13. Oriented toward the throttle valve fitting 3, a stop step 33 is embodied on the bushing 13, protruding into a recess 34 of the throttle valve fitting 3. The second spring 29 subject to a bending restoring force is designed such that its spring force is less than that of the first spring 21 subject to bending. As a result, with its step 25, the bushing 13 is rotated so far by the first spring 21 subject to bending, counter to the force of the second spring 29 subject to bending, that the step 25 comes to rest on the lever 14 and the stop step 33, upon a rotational movement of the shaft 2, freely executes this same rotational movement as well within the recess 34. The second spring 29 subject to bending accordingly has no influence on the throttle valve 1 in the restoring direction. However, if the action of the first spring 21 subject to bending should be absent, for instance because of breakage, then the second spring 29 subject to bending comes into action and rotates the bushing 13, and hence the stop step 33, in the recess 34 until such time as the stop step 33 comes to rest on a stop face 35 of the throttle valve fitting 3—that is, until such time as this step 33 is no longer spaced apart from the stop face 35—and the second spring 29 subject to bending now acts, instead of the first spring 21, upon the shaft 2 of the throttle valve 1 in the restoring direction. The device is small in size as a result of the disposition of the second spring 29 subject to bending inside the first such spring 21. The disposition of the second spring 29 subject to bending assures the proper functioning of the throttle valve 1 if the first spring 21 should fail.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A restoring device for adjusting an adjusting element relative to a housing for a throttle device of an internal combustion engine including:

a rotatable shaft having an end protruding from said housing, an actuation member secured to said rotatable shaft for rotating said shaft, a bushing rotatably supported on said shaft between said housing and said actuation member, said bushing including a step on one end thereof which engages said actuation member and a stop step on its other end which protrudes into a recess in said housing which has a stop face at the end of said recess, a first helical spring surrounding said bushing, one end of said spring is supported by and engages a protrusion on said housing and another end of said spring is supported by and engages said step on one end of said bushing to apply a restoring force on said actuation member, a second helical spring which has a lesser restoring force than said first helical spring is secured relative to said bushing coaxially with said first helical spring, one end of said second helical spring engages said actuation member and the other end of said second helical spring engages said bushing near said stop step on said bushing which stop step protrudes into said recess in said housing, whereby said second helical spring operates to provide a restoring force on said actuation member only in the event said first spring becomes nonfunctional.

2. A restoring device as defined by claim 1, which in the event of a defect on the part of said first spring, said bushing is rotated by said second spring so that said stop step of said bushing comes to rest on said stop face of said housing and said second spring reacts in a restoring direction upon the actuation member.

3. A restoring device as defined by claim 2, in which said second spring is disposed in an annular groove of the bushing.

4. A restoring device as set forth in claim 1 which includes a bearing bushing fixed on a portion of said housing which extends over a portion of said bushing upon which one end of said first spring is secured.

* * * * *